United States Patent [19]

Kawamoto et al.

[11] 4,125,144

[45] Nov. 14, 1978

[54] REFRACTORY MATERIAL FOR LABELING, WHICH CONTAINS AN ACTIVATABLE ELEMENT

[75] Inventors: Junichi Kawamoto, Aichi; Yasuo Ito; Akio Ito, both of Nagoya; Tamotsu Nakamua, Aichi; Motoyuki Nakamura, Nagoya; Yoshiaki Yamaoto, Nagoya; Koji Yonekura, Nagoya, all of Japan

[73] Assignee: Toyota Jidosha Kogyo Kabushiki Kaisha, Toyota, Japan

[21] Appl. No.: 682,459

[22] Filed: May 3, 1976

Related U.S. Application Data

[63] Continuation-in-part of Ser. No. 521,132, Nov. 5, 1974, abandoned.

[30] Foreign Application Priority Data

Nov. 8, 1973 [JP] Japan ..... 48-12583

[51] Int. Cl.[2] ..... B22C 1/00

[52] U.S. Cl. ..... 164/4; 164/138; 250/302; 250/391

[58] Field of Search ..... 164/4, 138; 250/302, 250/303, 390, 391

[56] References Cited

U.S. PATENT DOCUMENTS

| | | | |
|---|---|---|---|
| 2,874,303 | 2/1959 | Lane | 250/303 |
| 3,617,747 | 11/1971 | Wilkinson et al. | 250/391 X |

*Primary Examiner*—Francis S. Husar
*Assistant Examiner*—K.Y. Lin
*Attorney, Agent, or Firm*—Brisebois & Kruger

[57] ABSTRACT

The present invention relates to a refractory materials used in processing molten metals comprising combining at least one of the refractory materials selected from the group consisting of $SiO_2$, $Al_2O_3$, MgO, $ZrO_2$ with an activatable element for labeling which has an activation cross section of over 1 barnand apparatus made from a plurality of differently labeled refractory components.

11 Claims, 2 Drawing Figures

REFRACTORY MATERIAL FOR LABELING, WHICH CONTAINS AN ACTIVATABLE ELEMENT

CROSS REFERENCE TO RELATED APPLICATION

This application is a continuation-in-part application of application Ser. No. 521,132, filed Nov. 5, 1974, and now abandoned.

BACKGROUND OF THE INVENTION:

Production of crude metal castings or finished metal castings usually involves the processes of melting, refining and casting. In these processes the molten metal comes into contact with the melting furnace, the molten metal vessel, the runner and the mold, which are built of non-metallic materials such as refractories. Thus it sometimes happens that the crude metal castings or finished metal castings contain non-metallic inclusions which orginate from the refractories. These non-metallic inclusions, which greatly hinder the working of the crude casting or injure the functions of the finished product, should be eliminated as far as possible. As stated above, however, the production process of crude metal castings or finished metal castings involves a number of sources for the non-metallic inclusions such as the linings of the melting furnace, the molten metal vessel, the runner and the mold, which are invariably built of refractories containing similar elements.

For this reason it is difficult to trace the sources of the non-metallic inclusions in the material or product, even through analysis. It is still more difficult to determine what refractories at the traced source make these inclusions.

Thus under the present circumstances no appropriate counter-measure can be immediately taken when non-metallic inclusions are found in the material or product.

For the purpose of locating the source of non-metallic inclusions contained in the material or product owing to the casting, a method of utilizing the radioisotope as the tracer has been tried in the laboratory. In the practical application of this method, however, it is extremely difficult to reliably shield the operator from the radiation of radioisotopes which have to be concentrated enough to enable the measurement, while the dispersion of used radioisotopes is unavoidable. It is for these reasons that the radioisotope method still fails to become practical.

SUMMARY OF THE INVENTION

The object of the present invention is to provide a method of labeling refractory material which makes it possible to easily locate the source of non-metallic inclusions of crude castings or finished castings obtained through casting, by using instead of the above inconvenient radioisotope method the activation analysis method, which needs no radiation source in the casting shop and never affects the performance of refractories to be used for casting.

BRIEF EXPLANATION OF THE ATTACHED DRAWINGS

DETAILED EXPLANATION OF THE INVENTION

Figure 1:
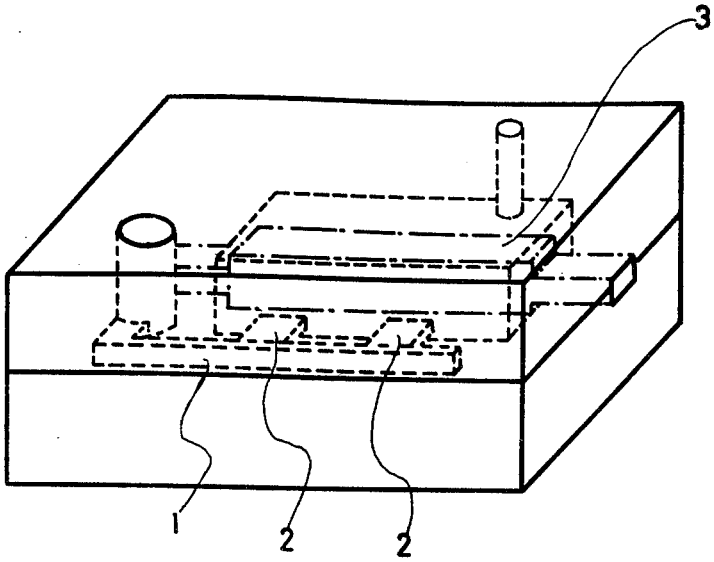
FIG. 1 is a perspective view of the mold which is built of the labeling refractory materials according to the present invention.

The present invention relates to a method of labeling refractory material to be used for locating the source of non-metals existing as impurities within metal castings. To be more specific, the present invention relates to a refractory material for labeling which contains an activatable element, characterized in that at least one of the refractory materials such as $SiO_2$, $Al_2O_3$, MgO, $ZrO_2$ is combined with 0.05–5 weight % of one activatable element for labeling having an activation cross section of over 1 barn such as Ba, Be, Ce, Co, Cr, Ga, Ge, Na, Gd, La, Nb, Sr, Sn, Ta, Ti, V, W, Y, Hf or Zn.

The labeling refractory material of the present invention is used as a refractory to constitute a specific refractory component or its specific part in a series of casting processes. A piece containing non-metallic inclusions is cut out of the crude material or the finished product, activated through irradiation by thermal neutron in a nuclear reactor; and its radiation is submitted to $\gamma$-ray spectrometry for identification of the element contained therein. Thus by checking whether or not said non-metallic inclusions in the piece contain the specific activated labeling substance as combined with the labeling refractory in the non-metallic inclusions, it is known from what specific refractory component or from what part thereof the non-metallic inclusions originate.

When a plurality of labeling refractories containing different activatable elements are used, the sources of a plurality of refractory components or products can be located at the same time.

The activatable labeling elements such as Ba in the labeling refractory material of indefinite form according to the present invention gives no adverse effect on the properties of refractory, because their content is less than 5 weight % (hereinafter the percentage is invariably in weight) and they are combined in refractories such as $SiO_2$. Moreover these activatable elements such as Ba have a thermal neutron activation cross section as wide as over 1 barn and their radioisotopes obtained through nuclear reaction have a relatively long life; therefore they can be measured with high accuracy. Portions containing the non-metallic inclusions have only to be cut out for activation. They are easily stored with the least hazard of the activated substance being dispersed.

For the labeling refractory material of the present invention, the activatable element for labeling must be one that can exist as a solid solution or a chemical compound in a refractory such as $SiO_2$ or can combine with the refractory when the molten metal is poured.

It should not happen that the labeling element or the substance containing it separates from the refractory through thermal shock or when the molten metal is poured, and gets mixed with the molten metal, or the labeling element separates from the refractory under the effect of the heat of the molten metal. For this reason a simple mixture of the refractory with the labeling element or a substance containing such an element will be ineffective as the labeling refractory material.

The available materials for the labeling refractory are one or more of the group generally known as silica, alumina ($Al_2O_3$), magnesia (MgO) and zirconia ($ZrO_2$), and even materials containing impurities of other elements than the labeling element. As the labeling element, an activatable element such as Ba which has an activation cross section of over 1 barn is used and it is combined chemically or as solid solution with the above-mentioned refractory material. The labeling element can be in the form of pure metal or can be a solid solution of metal oxide. The compounding ratio of the labeling element is 0.05–5 % and when it is short of 0.05%, the measurement will be difficult in analyzing it by the γ-ray spectrometry after activation of the labeling element, and often it becomes impossible to distinguish the labeling element from the refractory material other than the labeling one or from the other elements contained as impurities of the molten metal. When the ratio exceeds 5%, the refractory material suffers such a remarkable change due to the labeling element that it can no longer be equated to the common refractory material containing no labeling element.

According to the present invention, the refractory material, say, silica and a substance containing the labeling element such as barium sulfate are melted and mixed together in an arc melting furnace, to be cooled thereafter; a refractory block thus obtained can be crushed to an appropriate particle size. This method is identical with the conventional manufacture of refractory material with indefinite form except for the compounding with the labeling element.

The labeling refractory materials of indefinite form are used as particles or as products molded to a definite form such as the refractory brick. Before application of the labeling refractory it must be made sure that no labeling element is contained in the molten metal for casting, the refractory binder, the paint or in the parts for casting which are likely to be the source of such an element in the castings. For instance, if titanium is contained in the molten metal for casting and water-glass containing sodium is used as the refractory binder, titanium and sodium are ineligible as the labeling element. The labeling refractory material to be selected should be one containing a labeling element which is not likely to get mixed into the castings.

For the purpose of locating the source of non-metallic inclusions in crude castings such as the ingot, the lining bricks of the furnace, the liner of the ladle, the nozzle-stopper and the runner are built of labeling refractories with different labeling elements; and the non-metallic inclusions of the ingot can be traced to their sources by the labeling elements identified therein. In case the refractory drops out of the surface of the mold and forms a non-metallic inclusion in the finished castings, the surface of the runner 1, the surface of the gate 2 and the core 3 are built of different labeling elements, as illustrated in FIG. 1 which perspectively shows a model of the mold section; thus the sources of the non-metallic inclusions in the finished castings can be traced by the labeling elements contained therein. When the casting mold is to be partially built of the labeling refractory, a common refractory may be provided to form the mold after the labeling refractory has been laid out on a part of the surface of the wooden mold constituting the mold; or the mold can be split into a number of sections, each section being built of a different labeling refractory.

Small pieces are cut out of the crude casting or the finished casting which contains the non-metallic inclusions and prepared as activation samples. Non-metallic inclusions need not be exposed on the surface of the sample; they can be buried deep in the sample. Thus it is desirable, when the non-metallic inclusions are hidden deep in the finished castings, that the portions that are supposed to contain them be cut out as activation samples. If non-metallic inclusions traceable to the labeling refractories are contained in the samples, the labeling elements therein will be activated and presence of the inclusions will be confirmed by the γ-ray specific to the elements.

For activation, the samples are placed in a nuclear reactor, where they are submitted to about 5 hours of irradiation by neutrons with a density of about 1–2 × $10^{12}$ n/cm$^2$.sec.

The size of the activation sample depends on the sample-receiving capacity of the nuclear reactor. Samples of about 1 cm$^3$ in size are found appropriate for the nuclear reactors available in Japan.

An embodiment of the present invention is to be described.

Figure 2:
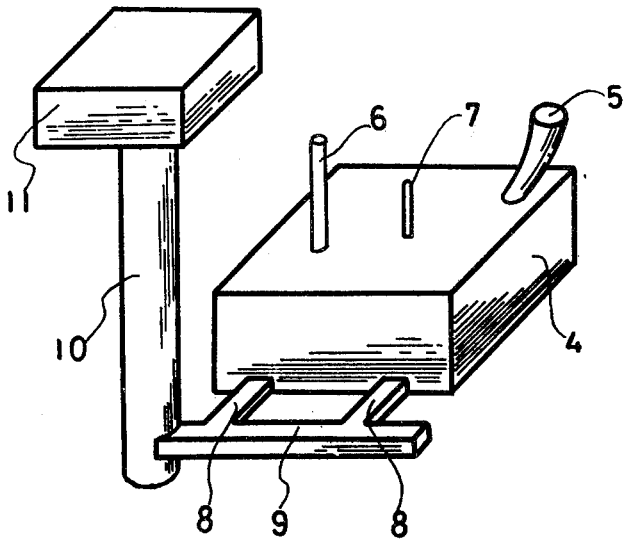
FIG. 2 is an oblique view showing the cavity of the mold used in the embodiment, in which 1 is the wall constituting the runner, 2 is the wall constituting the inlet. 3 is the core, 4 is the cavity which holds the product, 8 is the gate, 9 is the runner, and 10 is the sprue.

Silica particles 100 parts (hereinafter weight parts) were well blended with 5 parts of particles of chromium oxide ($Cr_2O_3$). The well mixed particles thus obtained were melted in an Arc furnace, yielding a block of soild-solution of chromic acid in silica. This block of silica was then crushed into labeling refractories of 120–150 meshes. In the same way, three kinds of labeling refractories of 120–150 meshes containing 5 parts of one compound selected from among $Ta_2O_5$, $La_2O_3$ and $HfO_2$ and 100 parts of silica particles were prepared, while four kinds of labeling refractory materials containing a solid solution of one element selected from amoung Cr, Ta, La and Hf as the labeling element were prepared. Next, for the purpose of manufacturing a casting mold with a cavity as schematically shown in FIG. 2, mold sections with the above-mentioned four kinds of labeling refractories as the main components were built and assembled into a set of molds. The cavity 4 which was to become a product measured about 30cm long and wide, and about 20cm high and this part of the mold was constituted of the Cr-containing labeling refractory material as the main component with the addition of Kibushi clay, a kind of Kaolinite ($Al_2O_3.2SiO_2.2H_2O$) and chamotte. Upon casting the mold, the mixing ratio of the refractory material, chamotte, Kibushi clay and water was 100 parts, 5 parts, 5 parts and 5 parts respectively. The section which held the cavity 4 which was to become a product was provided with cavities for the dead head 5 and the riser 6 as well as the vent 7. Using the Ta-containing labeling refractory material as the main component and additionally using the casting sands with additions of Kibushi clay and chamotte, two mold sections with gates 8, 8 each with a sectional area of about 6 cm$^2$ were built. Using the La-containing labeling refractory material as the main component and additionally using the green sands with additions of Kibushi clay and chamotte, a mold section with a runner 9 of sectional area about 7 cm$^2$ was built. Meanwhile, using the Hf-containing labeling refractory material as the main component and additionally using the casting sands with additions of Kibushi clay and chamotte, a mold section with a sprue 10 and an inlet 11 of sectional area about 8 cm$^2$ was built. Next, using the above-mentioned set of molds, a molten cast iron of about 1410° C. was poured through the inlet 11, yielding a cast block of 30 cm in length and width and 20 cm in height.

Several portions with non-metallic inclusions were cut out of the top and bottom of this block and several samples measuring 1 × 1 × 1 cm each were taken therefrom. Said samples were then placed in a nuclear reactor and irradiated for 5 hours with a neutron flux of neutron density about $2 \times 10^{12}$ n/cm$^2$.sec. Each sample thus activated was submitted to the $\gamma$-ray spectrometry for the possible $\gamma$-ray emitted from $51_{Cr}$, $182_{Ta}$, $140_{La}$, and $181_{Hf}$. As the result the $\gamma$-ray from $181_{Hf}$ was detected in the sample taken from the top of the cast block and the $\gamma$-ray from $140_{La}$ was detected in the sample taken from the bottom of the block, but the $\gamma$-rays from $51_{Cr}$ and $182_{Ta}$ were not detected. Thus it was revealed that the non-metallic inclusions in the top of the block originated from the refractory which constituted the sprue 10, while the non-metallic inclusions in the bottom of the block originated from the refractory which constituted the runner 9. The manufacture of the refractory material for labeling can be done with MgO, $ZrO_2$, $Cr_2O_3$ instead of the above-mentioned silica particles. In the case of MgO, the same conditions that Silica ($SiO_2$) had were applied, but in the case of $ZrO_2$, $Cr_2O_3$, it was necessary to make a slight rise in the melting temperature (2,000° C.).

We claim:

1. A method of locating the source of impurities in a casting comprising the following steps:

producing each of a plurality of constituent parts of a casting mold from a refractory material containing a different activatable element, each of said mold parts including a surface adapted to contact molten metal during pouring;

pouring molten metal into said casting mold, said molten metal absorbing impurities in the form of non-metallic inclusions originating from said surface of said mold parts;

disassembling the casting mold after the solidification of said molten metal;

activating activatable elements within said impurities in said casting after said disassembly;

identifying the individual activated elements in said impurities; and comparing the identified elements with the materials of said mold parts to locate the source of said impurities.

2. The method of locating the source of impurities of claim 1, wherein the refractory material is at least one material selected from the group consisting of $SiO_2$, $Al_2O_3$, MgO and $ZrO_2$.

3. The method of locating the source of impurities of claim 1, wherein the activatable element is selected from the group consisting of Ba, Be, Ce, Co, Cr, Ca, Ge, Na, Cd, La, Nb, Sr, Sn, Ta, Ti, V, W, Y, Hf and Zn.

4. The method of locating the source of impurities of claim 1, wherein the amount of activatable element is 0.05–5 weight % of the refractory material.

5. The method of locating the source of impurities of claim 1, wherein the refractory material is combined with the activatable element in solid solution or by chemical bonding.

6. The method of claim 4 in which each activatable label element is in with the refractory material in the form of a pure metal or an oxide.

7. The method of locating the source of impurities of claim 1, wherein said refractory material is used together with conventional refractory materials for a casting mold.

8. The method of locating the source of impurities of claim 1, wherein a molten metal container for pouring said metal and a furnace for heating said metal are each made of a refractory material containing different activatable elements.

9. The method claimed in claim 1 in which a piece is cut from said casting and only the activatable elements found in said piece are activated.

10. Method as claimed in claim 1 in which said activatable elements are activated by radiation.

11. Method as claimed in claim 1 in which said individual activated elements are identified by X-ray spectrometry.

* * * * *